US009388019B2

(12) United States Patent
Carparelli et al.

(10) Patent No.: US 9,388,019 B2
(45) Date of Patent: Jul. 12, 2016

(54) ELEVATOR CAR

(75) Inventors: Donato Carparelli, Lugano-Pregasona (CH); Nicolas Gremaud, Richterswil (CH); Eric Rossignol, Gordola (CH)

(73) Assignee: Inventio AG, Hergiswil (CH)

( * ) Notice: Subject to any disclaimer, the term of this patent is extended or adjusted under 35 U.S.C. 154(b) by 339 days.

(21) Appl. No.: 13/518,640

(22) PCT Filed: Nov. 17, 2010

(86) PCT No.: PCT/EP2010/067704

§ 371 (c)(1), (2), (4) Date: Aug. 27, 2012

(87) PCT Pub. No.: WO2011/076494

PCT Pub. Date: Jun. 30, 2011

(65) Prior Publication Data

US 2012/0318616 A1 Dec. 20, 2012

(30) Foreign Application Priority Data

Dec. 23, 2009 (EP) ..... 09180543

(51) Int. Cl.
*B66B 11/02* (2006.01)
*B66B 13/08* (2006.01)

(52) U.S. Cl.
CPC ..... *B66B 13/08* (2013.01); *B66B 11/0226* (2013.01)

(58) Field of Classification Search
CPC ..... B66B 13/08; B66B 13/12
USPC ..... 187/334, 319, 324
See application file for complete search history.

(56) References Cited

U.S. PATENT DOCUMENTS

| | | | | | |
|---|---|---|---|---|---|
| 1,866,392 | A | * | 7/1932 | Brady | 187/324 |
| 2,572,196 | A | * | 10/1951 | Raque | 49/138 |
| 2,859,835 | A | * | 11/1958 | Borden | 187/319 |
| 5,323,876 | A | * | 6/1994 | McAllister et al. | 187/316 |

FOREIGN PATENT DOCUMENTS

| | | | |
|---|---|---|---|
| JP | 2009-208947 | A | 9/2009 |
| JP | 2009-249155 | A | 10/2009 |

* cited by examiner

*Primary Examiner* — William E Dondero
*Assistant Examiner* — Diem Tran
(74) *Attorney, Agent, or Firm* — Fraser Clemens Martin & Miller LLC; William J. Clemens

(57) ABSTRACT

An elevator car has a car body with movably mounted car door leaves having upper guide rollers and a roof frame which stabilizes the car body. In addition, there is a door drive for moving the car door leaves and a horizontal door guide rail for mounting and guiding the car door leaves. A door drive carrier is arranged on a horizontal surface on an upper face of the roof frame horizontally along an upper front horizontal edge of the car body. The door drive carrier has a vertical surface section which runs parallel to a vertical front side of the roof frame and a horizontal surface section which runs parallel to the horizontal surface of the roof frame. The guide rail is fastened directly to the vertical front side of the roof frame.

14 Claims, 7 Drawing Sheets

ELEVATOR CAR

FIELD

The invention relates to an elevator car having at least one car door leaf mounted horizontally displaceably on the elevator car.

BACKGROUND

The design and construction of elevator systems is based on the principle that as little installation space as possible is taken up by functional units and components so that a greater share of the small installation space in the elevator shaft is available for an elevator car having the greatest possible floor space of the passenger area.

Additional passenger area can be obtained in particular in the installation space between the front face of the elevator car and the front wall of the elevator shaft, in which the car doors and the shaft doors with the door drive components, the car door/shaft door coupling device and safety mechanisms, etc. are arranged.

FIG. 1 shows a schematic illustration of details of the car body 1 of a known elevator car. The expression "car body" is to be understood in the present description to mean the part of an elevator car which forms a closable housing and normally comprises a car floor, a car ceiling, wall elements connecting the car floor and the car ceiling, and a door system. Such a car body can be supported by a car frame, wherein the car frame is suspended from bearing means and is guided on car guide rails in an elevator shaft. However, a car body can also be self-supporting, wherein a separate car frame is not provided and the car body is suspended directly at bearing means via guide elements attached to the car body and is guided on car guide rails.

FIG. 1 shows a sectional view through a front upper part of the car body 1 of an elevator car. A car door leaf 10.1 can be seen to the left in FIG. 1. The car door leaf 10.1 comprises a carriage 15, which is formed by a plate 11.1 with guide rollers 12. This carriage 15 moves along a door guide rail 2, which is connected mechanically to a door support profile 3 via a spacer 9, said door support profile being fastened to front profiles 1.1 of the car body 1. This type of suspension of the carriage 15 allows a horizontal opening and closing movement of the car door leaf 10.1 in a plane perpendicular to the plane of the drawing. At the lower end, the car door leaf 10.1 can be guided for example in a guide groove 5.2 in a car door sill 5.1 of the car floor 5. FIG. 1 shows that a car door/shaft door coupling device 14 is attached typically on the front face so as to convert a horizontal displacement of a car door leaf 10.1 into a synchronous horizontal displacement of a shaft door leaf. JP-2009208947 describes such a door support profile.

FIG. 2 shows a schematic perspective illustration of details of a further known elevator car. The "car body" 1, which is normally supported by a car frame (not shown here) which is suspended from bearing means and is guided on car guide rails in the elevator shaft, is illustrated. In this case, a car floor 5, a ceiling panel 6, a side wall 7, a front wall 8 and two car door leaves 10.1 and 10.2 can be seen. Each car door leaf 10.1, 10.2 is suspended from a carriage 15, which comprises a plate 11.1 and 11.2 with guide rollers 12 (the guide rollers 12 cannot be seen in this case, since they are arranged behind the plates 11.1, 11.2). The two carriages 15 move along a door guide rail 2, which is formed in this case of two profile strips 2.1, 2.2 arranged in a vertical plane. These profile strips 2.1, 2.2 are fastened to a C-shaped door support profile 3. This C-shaped door support profile 3 in this case comprises a lower horizontal strip 3.3, a rear vertical face 3.2, and an upper horizontal strip 3.4. The C-shaped door support profile 3 is fastened in the upper region of the front wall 8 of the car body 1. This type of suspension and guidance of the carriages 15 enables a horizontal opening and closing movement of the car door leaves 10.1, 10.2. At their lower end, the car door leaves 10.1, 10.2 can be guided in a guide groove in the car door sill 5.1 of the car floor 5. The car door/elevator door coupling devices 14 are also shown in this figure.

Elements which take up an unnecessarily large amount of installation space and contribute unnecessarily to overall mass are provided in the installation space on the front face 8 of the car body 1.

The moved mass of the elevator car plays a role in the optimization of the overall elevator system, since this mass accelerates during each journey of the elevator car and has to be slowed down. This results in conflicts of interest, for example between the requirement for sufficient load-bearing capacity and stability of the elevator car and the requirement for minimal mass.

SUMMARY

In consideration of the disadvantages of known solutions, the object is to present a space-saving and weight-saving device for moving and guiding the car door leaves.

Details of the invention and the advantages thereof will be explained in greater detail in the following part of the description.

DESCRIPTION OF THE DRAWINGS

The invention will be described in detail hereinafter on the basis of examples and with reference to the schematic drawings, in which.

DETAILED DESCRIPTION

Figure 1:
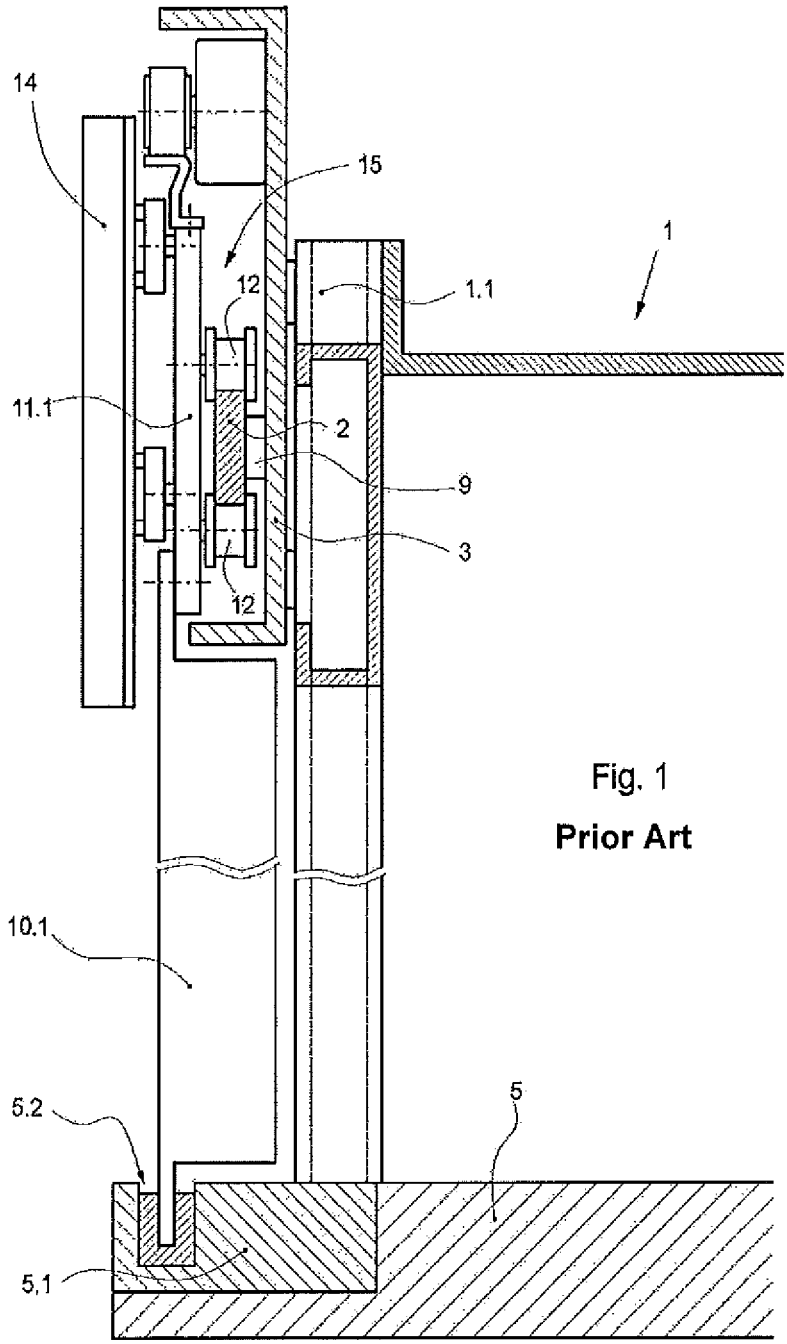
Fig. 1 Prior Art
FIG. 1 shows a schematic sectional illustration of part of a car body of a previously known elevator car with a door support profile (door transom)

In the following exemplary embodiments, like reference characters denote like or functionally like components.

Figure 3:
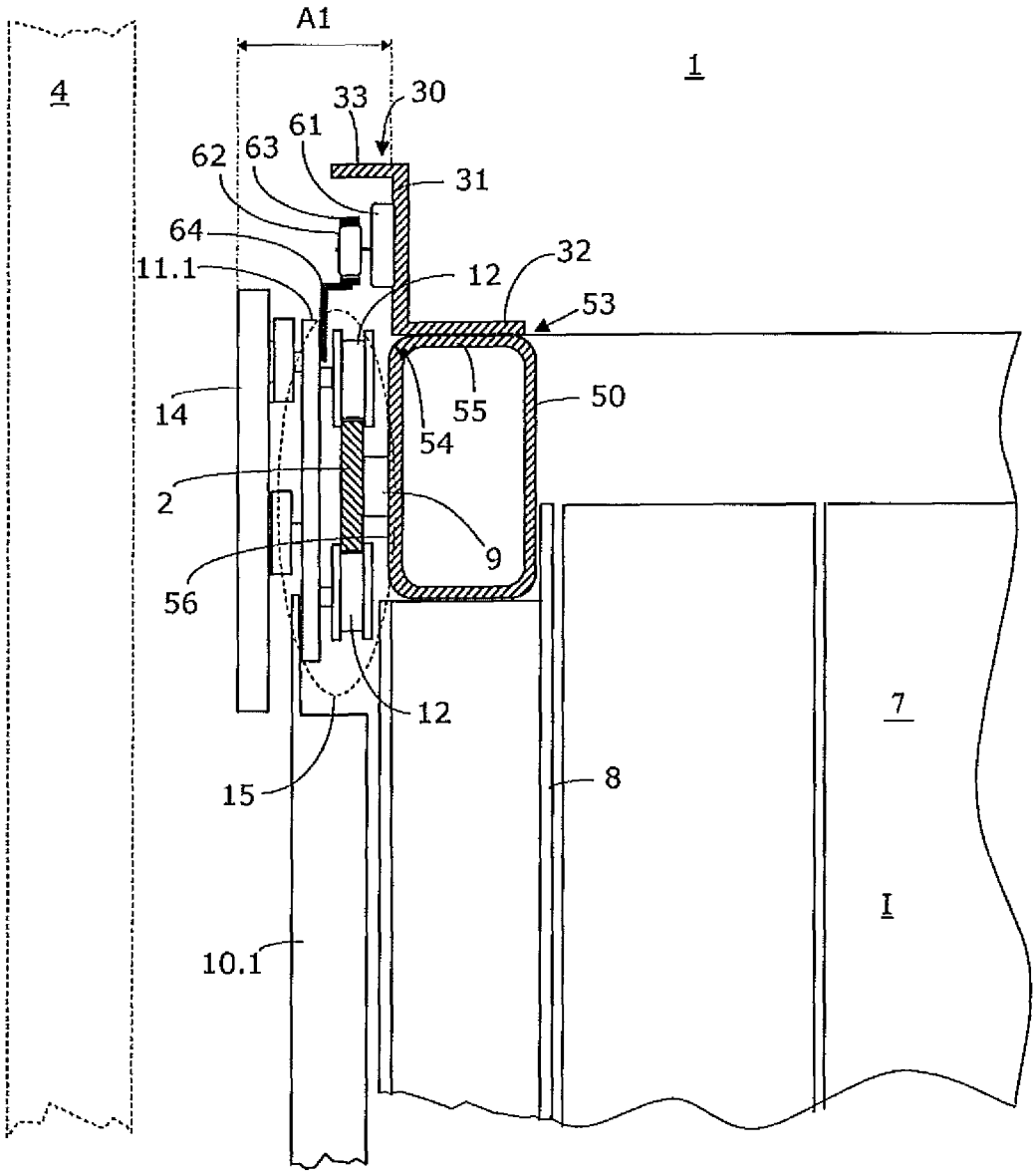
FIG. 3 shows a schematic sectional illustration of the front upper part of an elevator car according to the invention with a drive means support fitted on a ceiling frame of the car body.

A first embodiment of the invention will be described with reference to FIG. 3. In this figure, the upper front part of a car body 1 of an elevator car is shown in a schematic sectional illustration. The section runs through a front hollow profile of a ceiling frame 50. This ceiling frame 50 is part of the car body 1 and is used, inter alia, to stabilize the car body. The interior of the car body 1 is indicated in FIG. 3 by the reference letter I. The car body 1 has a plurality of wall elements, which serve as perpendicular car walls 7, 8. The wall elements can be fastened for example internally or externally to the ceiling frame 50 depending on the embodiment, as indicated with reference to the front wall 8.

The car body 1 further comprises at least one car door leaf 10.1, which is arranged in the region of the front face of the car body containing the car doors. The car door leaf 10.1 is suspended from a carriage 15 having guide rollers 12. A door guide rail 2 serves to guide the guide rollers 12 of the carriage 15 of the car door leaf 10.1 and therefore to guide the entire car door leaf. The door guide rail 2 is arranged on the vertical front face 56 of the ceiling frame 50 and is fastened directly to the ceiling frame 50 via at least one spacer 9. Such a spacer could be omitted, and the door guide rail 2 could rest directly against the ceiling frame if the door guide rail were to have a cross-section corresponding approximately to the joint cross-section of the illustrated door guide rail 2 and the spacer 9.

Drive means are provided to move the car door leaf 10.1. In the present case and hereinafter, the expression "drive means" is understood primarily to mean a car door drive with the following components: a door drive motor 61 with a drive shaft 65 (FIG. 5), a drive pulley 62, a circulating door drive belt 63, a driver 64 and a belt return roller 66 (not visible in FIG. 3).

The door drive motor 61 drives the drive pulley 62 via the drive shaft 65 (see FIGS. 5, 6 and 9) and also drives the door drive belt 63 therewith. The driver 64, via which the door drive belt moves the carriage 15 and thus also the car door leaf 10.1, is coupled to this door drive belt 63. A car door/shaft door coupling device 14, which is designed to transfer the opening movement of the car door (in this case the car door leaf 10.1) to an opposite shaft door (not shown) when a floor is reached is also arranged on the carriage 15.

The above-mentioned drive means 61-66 for driving the car door leaf 10.1 guided on the door guide rail 2 are arranged on a drive means support 30. The drive means support 30 is fastened in the upper region of the front face 8 of the car body 1 to the ceiling frame 50 and has a Z-shaped cross-section. In this embodiment it runs in the region of the upper face 53 of the ceiling frame 50 along the upper horizontal edge 54 on the front face 8 of the car body 1. In this case, the drive means support 30 has a vertical surface portion 31, which runs parallel to the front face 8 of the car body 1, wherein the surface portion 31 is preferably aligned with the front face 56 of the ceiling frame 50 and forms a common vertical surface therewith. The drive means support 30 further comprises a horizontal surface portion 32, which runs at right angles to the front face 8 of the car body 1 and extends parallel to the horizontal surface 55 of the ceiling frame 50. The drive means support 30 is preferably connected to the horizontal surface 55 of the ceiling frame 50 via its horizontal surface portion 32. In addition, the drive means support 30 comprises a further surface portion 33, which extends approximately horizontally over said drive means 61-66 from the vertical surface portion 31 and protects said drive means against falling objects and against pollution.

Figure 2:
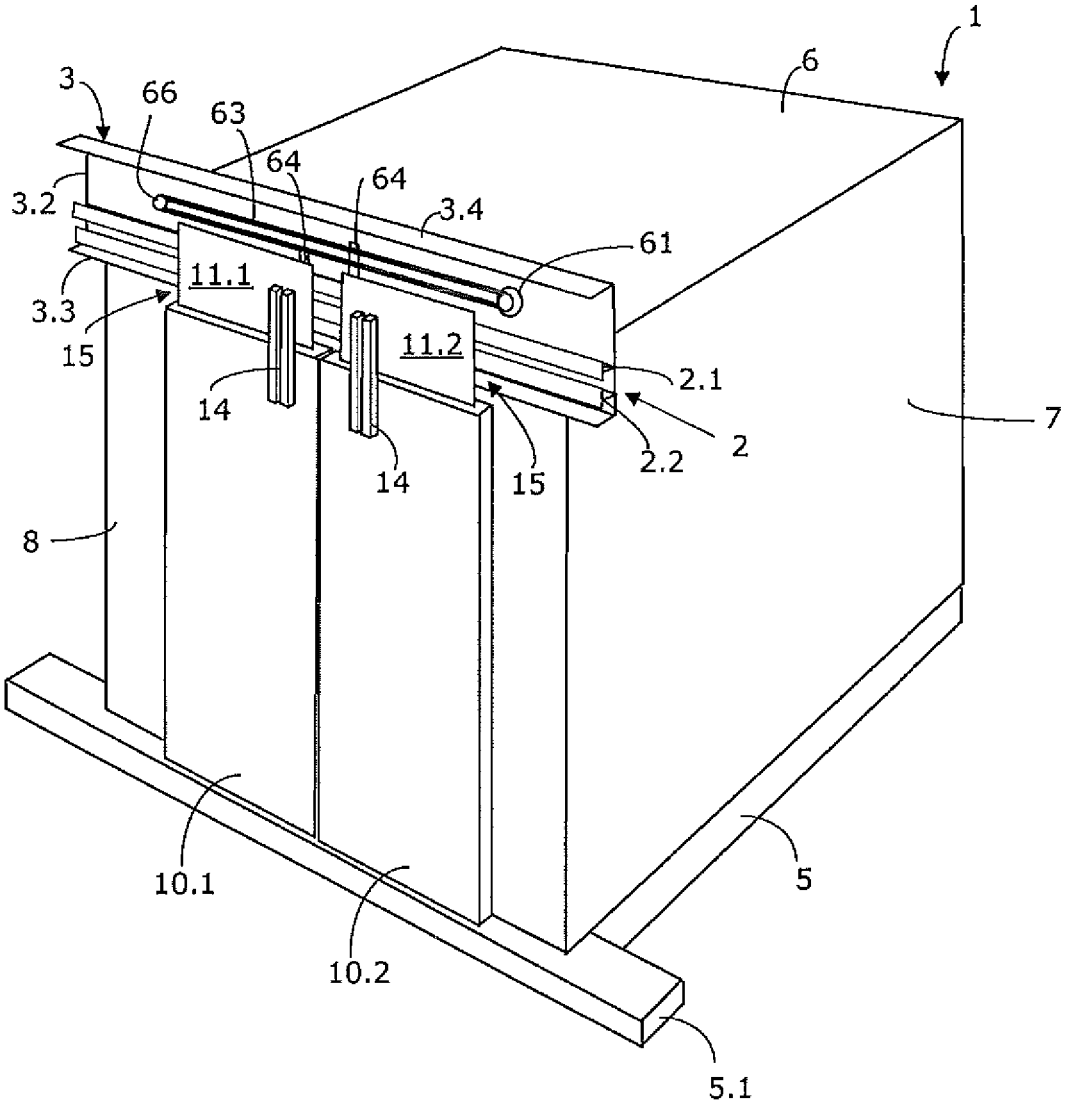
Fig. 2 Prior Art
FIG. 2 shows a schematic perspective illustration of a further previously known elevator car with a C-profile serving as a door support profile (door transom)

Compared to the prior art, the conventional C-shaped door support profile 3 (see FIG. 2) has thus been eliminated. In the embodiment shown in FIG. 3, the door guide rail 2 which was attached to this door support profile in the known prior art is fastened directly, or via at least one spacer, to the vertical front face 56 of the ceiling frame 50, and the door guidance forces are correspondingly introduced into this ceiling frame 50. The above-described drive means support 30 has been fitted and fastened from above on the ceiling frame 50 so as to be able to house all components previously arranged on the door support profile 3 on the front face 8 of the car body 1 of the elevator car.

Since the drive means support 30 sits on the top of the ceiling frame 50, less installation space is taken up on the front face 8 of the car body 1 than in the known embodiment with a C-shaped drive support profile according to the above prior art. In addition, the drive means support 30 reinforces the rigidity of the ceiling frame 50 as a result of its fixed connection to the ceiling frame 50. The ceiling frame 50 and the drive support profile 30 are preferably designed and dimensioned jointly so that they together have the necessary rigidity. Nevertheless, this spatially optimized arrangement provides a uniform, planar or practically planar vertical surface for the arrangement and fastening of the drive means mentioned.

Figure 4:
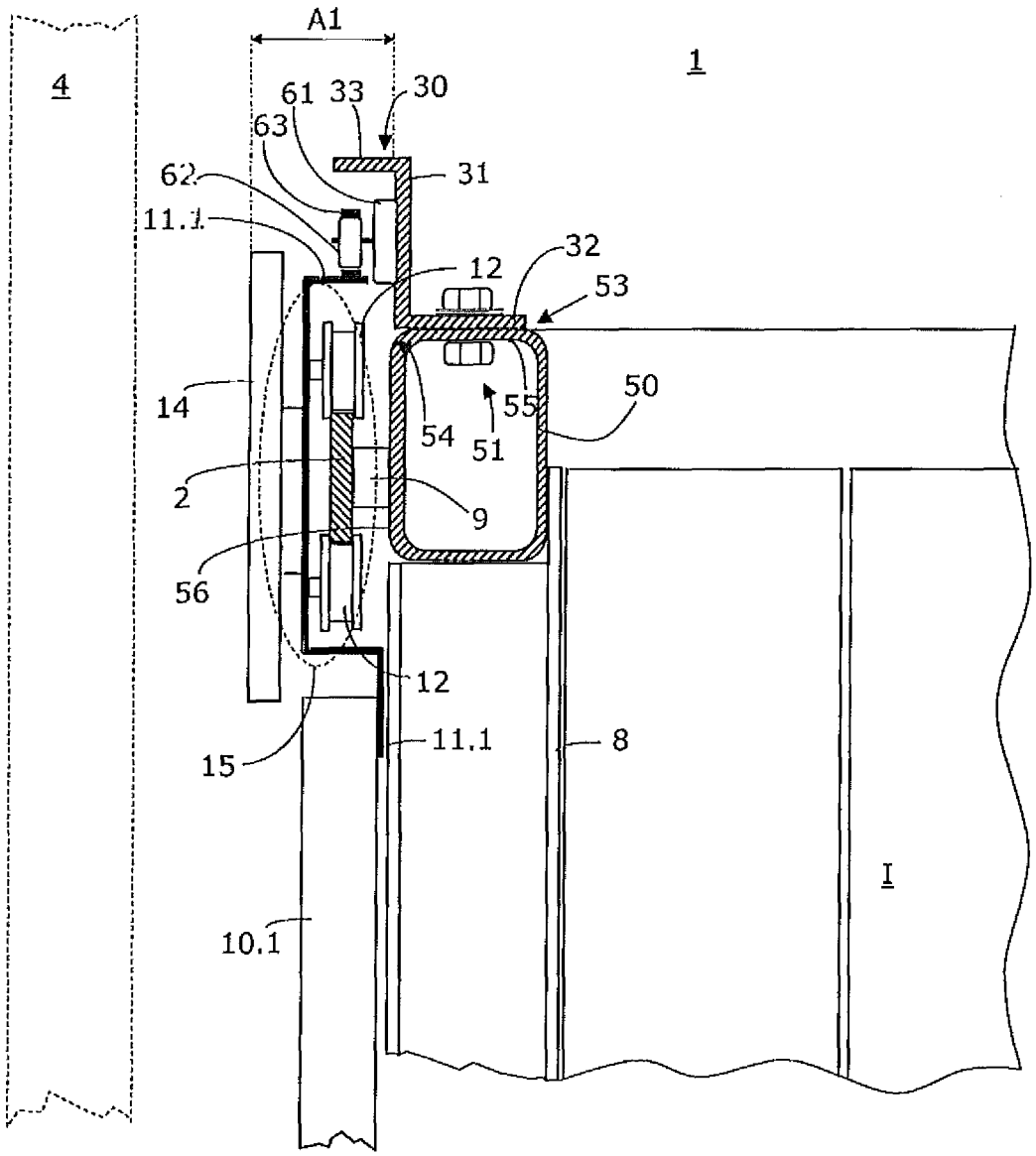
FIG. 4 shows a schematic sectional illustration of the front upper part of a further elevator car according to the invention with a drive means support fitted on a ceiling frame of the car body.

A further embodiment of the invention is illustrated in FIG. 4. Only those elements which differ from the elements of FIG. 3 will be described hereinafter. Reference is made to the description of FIG. 3 for the remaining elements.

In the embodiment according to FIG. 4, the drive means support 30 is also arranged on the upper face 53 of the horizontal surface 55 of the ceiling frame 50. The door drive motor 61 and the other drive means 62, 63 are arranged on the vertical surface portion 31 of the drive means support 30. The door guide rail 2 for the carriage 15 is fastened directly, or via at least one spacer 9, to the vertical front face 56 of the ceiling frame 50. The carriage consists substantially of a bent sheet profile 11.1 (in this case illustrated by a thick black line) and guide rollers 12 arranged on this sheet profile.

The drive means support 30 of the second embodiment according to FIG. 4 likewise has a Z-shaped cross-section and comprises the horizontal surface portion 32, the vertical surface portion 31, and the further horizontal surface portion 33.

The advantages mentioned above for the embodiment according to FIG. 3 also apply to this embodiment.

The installation depths A1 are identical or practically identical in the embodiments shown in FIGS. 3 and 4. The installation depth A1 relates to all elements of the drive means support 30 and to the drive elements 61-66, which protrude beyond the vertical front face 56 of the ceiling frame 50. The installation depth A1 also comprises the car door/shaft door coupling device 14.

The front shaft wall is indicated schematically in FIGS. 3 and 4 by the reference numeral 4.

Figure 5:
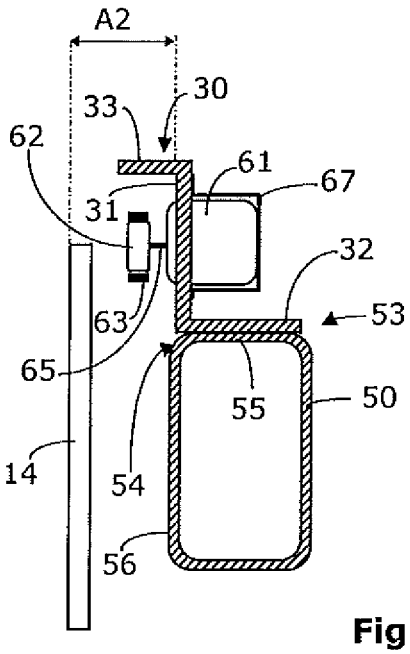
FIG. 5 shows a schematic sectional illustration of the front upper part of a further elevator car according to the invention with a drive means support fitted on a ceiling frame of the car body.

A sectional view of a further embodiment is shown in FIG. 5. Only those elements which differ from the elements of FIGS. 3 and 4 will be described hereinafter. Reference is hereby made to the description of FIGS. 3 and 4 for the remaining elements. FIG. 5 is a schematic illustration which, in this case, only shows the drive means support 30, the front (hollow) support of the ceiling frame 50, the door drive motor 61 and the drive pulley 62 with the door drive belt 63, and the drive shaft 65. The drive means support 30 is also fastened on the upper face 53 of the horizontal surface 55 of the ceiling frame 50 in this embodiment. The vertical front face 31 of the drive means support 30 and the vertical front face 56 of the ceiling frame 50 again form an overall surface, since both surfaces are aligned. The door drive motor 61 is arranged in this case in a recess in the drive means support 30, wherein either the door drive motor 61 or merely the drive shaft 65 thereof projects through the recess. A large part of the door drive motor 61, or the entire door drive motor 61, thus lies on the rear side (in this case on the right-hand side) of the drive means support 30. The door drive motor 61 can be protected by a metal sheet or by a housing 67.

The drive means support 30 of the second embodiment according to FIG. 5 likewise has a Z-shaped cross-section and comprises the horizontal surface portion 32, the vertical surface portion 31, and the further horizontal surface portion 33.

It is an advantage of this embodiment that the distance between the drive pulley 62 and the vertical front face 31 of the drive means support 30 is not defined by dimensions of the door drive motor 61, since the door drive motor 61 sits at least partially in the aforementioned recess in the drive means support 30. Due to this positioning of the door drive motor 61, the drive pulley 62 can sit more closely on the vertical front face 31, and therefore the horizontal surface portion 33 of the drive means support 30 can also be formed so as to be shorter if required (that is to say this surface portion 33 does not project as far beyond the vertical front face 56 of the ceiling frame 50 as in the prior art). The installation depth A2 is less in this case than in FIG. 3 or 4, that is to say A2<A1. In particular, the installation depth A2 is much smaller than in the prior art.

Figure 6:
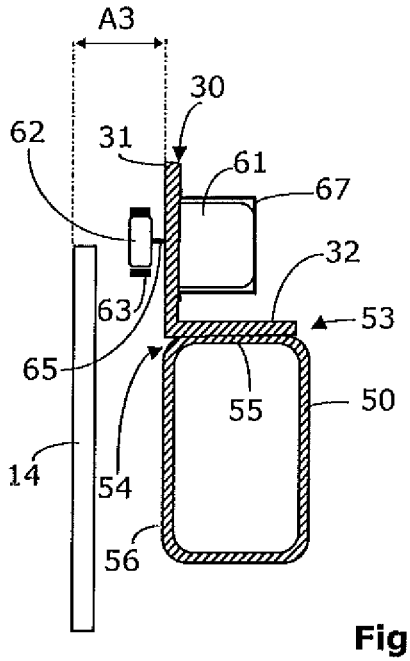
FIG. 6 shows a schematic sectional illustration of the front upper part of a further elevator car according to the invention with a drive means support fitted on a ceiling frame of the car body.

A sectional view of a further embodiment is shown in FIG. 6. Only those elements which differ from the elements of FIGS. 3, 4 and 5 will be described hereinafter. Reference is hereby made to the description of FIGS. 3, 4 and 5 for the remaining elements. FIG. 6 is a schematic illustration, which, in this case merely shows the drive means support 30, the front (hollow) support of the ceiling frame 50, the door drive motor 61 and the drive pulley 62 with the door drive belt 63, and the drive shaft 65. The drive means support 30 is also fastened on the upper face 53 of the horizontal surface 55 of the ceiling frame 50 in this embodiment. The vertical front face 31 of the drive means support 30 and the vertical front face 56 of the ceiling frame 50 again form an overall surface, since both surfaces are aligned. In this case, the door drive motor 61 is inserted completely into the drive means support 30.

By contrast to the embodiment shown in FIG. 5, an L-shaped drive means support 30 is used in this case. This drive means support 30 does not have a horizontal surface portion 33, as in the embodiment according to FIG. 5. The installation depth A3 is still less than in FIG. 5, that is to say A3<A2.

Figure 7:
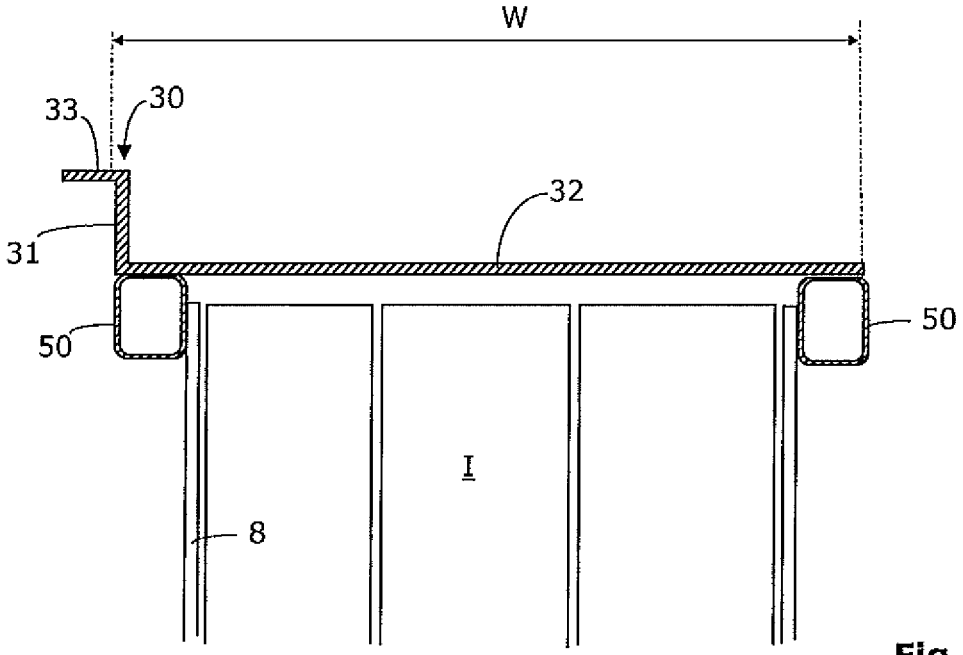
FIG. 7 shows a schematic sectional illustration of the ceiling region of a further elevator car according to the invention with a drive means support integrated in the ceiling panel of the car body.

A sectional view of a further embodiment is illustrated in FIG. 7 in highly schematic form. This embodiment is characterized in that the drive means support 30 comprises a horizontal surface portion 32, which extends over the entire ceiling depth W of the car body 1 and forms the car ceiling of the car body. Since, in this embodiment, the horizontal surface portion 32 of the drive means support 30 extends over the entire ceiling depth W, the entire car body 1 is additionally stabilized.

The drive means support 30 is preferably welded to the ceiling frame 50. However, it can also be screwed, as indicated schematically in FIG. 4 by a screw connection 51. This form of the screw connection 51 can be applied to all embodiments. A plurality of screws are required over the length of the drive means support 30 so as to connect it to the ceiling frame 50. Only in this way can the drive means support 30 be a bearing or concomitantly bearing element of the ceiling frame 50. A riveted or adhesively bonded connection may also be used in the alternative.

Figure 8:
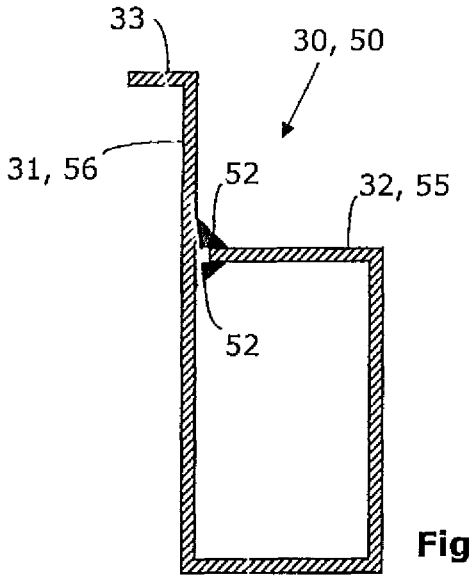
FIG. 8 shows a schematic sectional view through a ceiling frame profile of the car body of an elevator car according to the invention.

FIG. 8 shows a schematic sectional view through a front portion of a ceiling frame 50, in which the drive means support 30 is integrated in the ceiling frame profile. The profile of the ceiling frame 50 with the integrated drive means support 30 is produced from a single piece of sheet metal or flat steel. The vertical surface portion 31 of the drive means support 30 and the vertical front face 56 of the ceiling frame 50 in this case form a unit having a common front face. An end edge can be welded at right angles onto the rear face so as to close the profile of the ceiling frame 50 to form a hollow profile. The corresponding weld seams 52 are indicated schematically in FIG. 8. In addition to the advantages already discussed, this embodiment also provides the advantage that fewer parts are used on the whole. In addition, this embodiment is very rigid, although relatively little material has to be used. The front face of this ceiling frame 50 is completely flat over its entire length. The drive elements (61-66) can be fastened without difficulty in the entire region of this front face of the ceiling frame.

Figure 9:
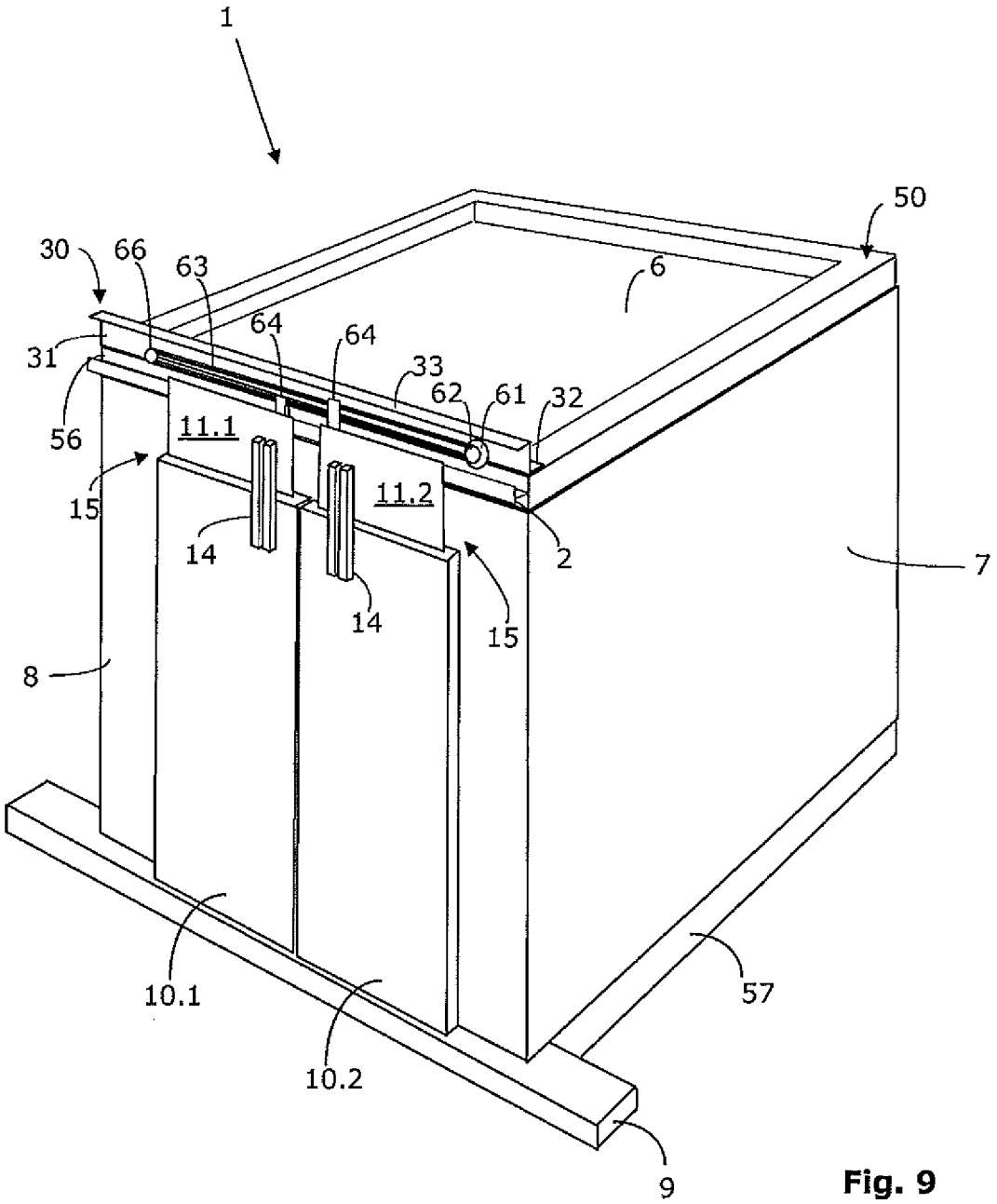
FIG. 9 shows a schematic perspective view of a car body of a further elevator car according to the invention.

FIG. 9 shows a schematic perspective view of the car body 1 of a further elevator car according to the invention. In this case too, reference is again made to the description of the previous embodiments. Different details, which were not visible in the sectional illustrations of the other figures, can be seen in FIG. 9.

A peripheral ceiling frame 50 is arranged in the region of the upper face of the car body 1. This ceiling frame 50 can be welded together from hollow profiles (as can be seen in FIG. 3, 4, 5, 6 or 7). The wall elements 7, 8 and other elements of the car body 1, for example the ceiling panel 6, are arranged on this ceiling frame 50. A floor frame 57 may be arranged in the floor region of the car body 1. This floor frame 57 may be largely identical to the ceiling frame 50. A Z-shaped drive means support 30 sits on the upper face of the ceiling frame 50 in the region of the front face of the car body 1, as described above. This drive means support 30 supports the drive means, that is to say the door drive motor 61, the drive pulley 62, a belt return roller 66, and the circulating door drive belt 63 with the drivers 64. The drivers 64 engage with the door drive belt 63 and move the plates 11.1, 11.2 of the two carriages 15. Guide rollers 12 (not visible in this case) roll along a horizontal door guide rail 2. This door guide rail 2 is formed of a flat profile, which is fastened directly, or via at least one spacer, to the vertical front face 56 of the ceiling frame 50 forming part of the car body 1. The stability of the ceiling frame 50 is increased by the drive means support 30, which is screwed on or welded on.

The embodiments shown can be applied to various elevator cars. For example, the technical teaching can be transferred to elevator cars either with or without a car frame, to elevator cars with upper or lower support rollers or with support means fixing points, and to elevator cars having door systems of any type.

Some further advantages of the described embodiments shown in the figures will be summarized hereinafter. On the whole, less material is required with the elevator cars according to the invention than with conventional solutions, because, on the one hand, the door support profile provided in elevator cars according to the prior art is largely omitted, and also because the ceiling frame 50 can be designed so as to be less stable, since the cooperation between the drive support profile 30 and ceiling frame 50 increases the stability of the ceiling frame. The overall mass on the one hand, and, on the other hand, the costs of the elevator car are thus reduced. Due to the reduction in the installation depth A1, A2, A3 required for the door assembly, a greater interior of the car body 1 can be formed with given dimensions of the elevator shaft. In addition, assembly is less complex, since the drive support profile 30 can be assembled on the car body at the factory. The drive means 61-66 and the door guide rail 2 (or 2.1, 2.2) can also be preassembled and above all also adjusted, for example at the factory. On the whole, a more precise and quieter guidance of the car door leaves 10.1, 10.2 is thus provided, and it is ensured, due to the relatively precise adjustment possible at the factory, that merely minimal wear occurs on the door drive belt 63. In addition, the ceiling frame 50 can be designed so as to be less stable, since the cooperation between the drive support profile 30 and the ceiling frame 50 results in increased stability.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. An elevator car having a car body, which car body includes a ceiling frame, wall elements connecting a car ceiling and a car floor, at least one horizontally displaceable car door leaf having upper guide rollers, a door drive for moving the at least one car door leaf, a drive means support on which the door drive is assembled, a door guide rail that guides the guide rollers and suspends the at least one horizontally displaceable car door leaf, comprising:

the door guide rail being fastened to a vertical front face of a horizontal portion of the ceiling frame extending in a horizontal direction along a front wall of the car body, the horizontal portion of the ceiling frame having a hollow profile and being connected to at least one of the wall elements, a portion of the ceiling frame extending vertically below a top edge of the wall elements; and the drive means support fastened to the ceiling frame and positioned above the door guide rail and the vertical front face of the ceiling frame, the drive means support increasing stability of the ceiling frame.

2. The elevator car according to claim 1 including a spacer positioned between the door guide rail and the vertical front face of the ceiling frame.

3. The elevator car according to claim 1 wherein the drive means support is arranged on a horizontal surface of an upper face of the ceiling frame extending horizontally along an upper front horizontal edge of the car body, the drive means support having a vertical surface portion that runs parallel to the vertical front face of the ceiling frame, and the drive means support has a horizontal surface portion that runs parallel to a horizontal surface of the ceiling frame.

4. The elevator car according to claim 1 wherein the drive means support is formed integral with the ceiling frame.

5. The elevator car according to claim 1 wherein the drive means support is fixed to the ceiling frame by one of being welded, riveted, adhesively bonded and screwed thereto.

6. The elevator car according to claim 1 wherein the drive means support has a Z-shaped cross-section that includes one horizontal surface portion, a vertical surface portion and another horizontal surface portion spaced from the one horizontal surface portion.

7. The elevator car according to claim 1 wherein the drive means support has an L-shaped cross-section that includes a horizontal surface portion and a vertical surface portion.

8. The elevator car according to claim 1 wherein the drive means support is formed from a metal sheet and also functions as a ceiling element of the car body.

9. An elevator car having a car body, which car body includes a ceiling frame and wall elements, at least one horizontally displaceable car door leaf having upper guide rollers, a door drive for moving the at least one horizontally displaceable car door leaf, a drive means support on which the door drive is assembled, a door guide rail that guides the upper guide rollers and suspends the at least one horizontally displaceable car door leaf, comprising:

the door guide rail being fastened to a vertical front face of a horizontal portion of the ceiling frame extending in horizontal direction along a front wall of the car body, the horizontal portion of the ceiling frame having a hollow profile and being connected to at least one of the wall elements; and the drive means support fastened to the ceiling frame and positioned above the door guide rail and the vertical front face of the ceiling frame, the drive means support increasing stability of the ceiling frame;

wherein the drive means support is arranged on a horizontal surface of an upper face of the ceiling frame extending horizontally along an upper front horizontal edge of the car body, the drive means support having a vertical surface portion that runs parallel to the vertical front face of the ceiling frame, and the drive means support has a horizontal surface portion that runs parallel to a horizontal surface of the ceiling frame; and wherein the door drive for moving the at least one horizontally displaceable car door leaf is arranged on the vertical surface portion of the drive means support.

10. An elevator car having a car body, which car body includes a ceiling frame and wall elements, at least one horizontally displaceable car door leaf having upper guide rollers, a door drive for moving the at least one horizontally displaceable car door leaf, a drive means support on which the door drive is assembled, a door guide rail that guides the upper guide rollers and suspends the at least one horizontally displaceable car door leaf, comprising:

the door guide rail being fastened to a vertical front face of a horizontal portion of the ceiling frame extending in a horizontal direction along a front wall of the car body, the horizontal portion of the ceiling frame having a hollow profile and being connected to at least one of the wall elements, a portion of the ceiling frame extending vertically below a top edge of the wall elements; and the drive means support fastened to the ceiling frame and positioned above the door guide rail and the front face of the ceiling frame, the drive means support increasing stability of the ceiling frame.

11. An elevator car having a car body with wall elements, at least one horizontally displaceable car door leaf having upper guide rollers, and a door drive for mounting the at least one horizontally displaceable car door leaf, comprising:

a ceiling frame included in the car body, the ceiling frame having a hollow profile;

a door guide rail that guides the upper guide rollers and suspends the at least one door leaf, the door guide rail being fastened to a vertical front face of a horizontal portion of the ceiling frame extending in a horizontal direction along a front wall of the car body, the horizontal portion of the ceiling frame having a hollow profile and being connected to at least one of the wall elements; and a drive means support on which the door drive is assembled, the drive means support being fastened to a horizontal upper face of the ceiling frame above the door guide rail and the front face of the ceiling frame, the drive means support increasing stability of the ceiling frame.

12. The elevator car of claim 11, wherein the ceiling frame is a square tube.

13. An elevator car having a car body with wall elements, at least one horizontally displaceable car door leaf having upper guide rollers, and a door drive for mounting the at least one horizontally displaceable car door leaf, comprising:

a ceiling frame included in the car body, the ceiling frame having a plurality of interior surfaces connected to each other and a plurality of exterior surfaces connected to each other;

a door guide rail that guides the upper guide rollers and suspends the at least one horizontally displaceable car door leaf, the door guide rail being fastened to a vertical exterior surface of a horizontal portion of the ceiling frame extending in a horizontal direction along a front wall of the car body, the horizontal portion of the ceiling frame having a hollow profile and being connected to at least one of the wall elements; and a drive means support on which the door drive is assembled, the drive means support being fastened to a horizontal exterior surface of the ceiling frame above the door guide rail, the drive means support increasing stability of the ceiling frame.

14. The elevator car of claim 13, wherein the ceiling frame is a square tube.

* * * * *